US012264443B2

(12) United States Patent
Winkels

(10) Patent No.: US 12,264,443 B2
(45) **Date of Patent: *Apr. 1, 2025**

(54) REMOVING EARTH WORKING METHOD WITH A REMOVING TOOL OFFSET OBLIQUELY WITH RESPECT TO THE PROPULSION DIRECTION, AND EARTH WORKING MACHINE EMBODIED TO EXECUTE THE METHOD

(71) Applicant: Wirtgen GmbH, Windhagen (DE)

(72) Inventor: Sebastian Winkels, Windeck (DE)

(73) Assignee: Wirtgen GmbH, Windhagen (DE)

( * ) Notice: Subject to any disclaimer, the term of this patent is extended or adjusted under 35 U.S.C. 154(b) by 52 days.

This patent is subject to a terminal disclaimer.

(21) Appl. No.: 18/492,857

(22) Filed: Oct. 24, 2023

(65) Prior Publication Data

US 2024/0125060 A1 Apr. 18, 2024

Related U.S. Application Data

(63) Continuation of application No. 17/120,732, filed on Dec. 14, 2020, now Pat. No. 11,802,384.

(30) Foreign Application Priority Data

Dec. 30, 2019 (DE) ..... 10 2019 135 867.1

(51) Int. Cl.
*E01C 23/088* (2006.01)
*E01C 19/00* (2006.01)
*E01C 23/12* (2006.01)

(52) U.S. Cl.
CPC ..... *E01C 23/088* (2013.01); *E01C 23/127* (2013.01); *E01C 19/004* (2013.01)

(58) Field of Classification Search
CPC .... E01C 23/088; E01C 23/127; E01C 19/004; B62D 7/026; B62D 7/1509; B62D 11/20
See application file for complete search history.

(56) References Cited

U.S. PATENT DOCUMENTS 3,767,264 A 10/1973 Eckey
3,895,843 A 7/1975 Wall et al.
(Continued)

FOREIGN PATENT DOCUMENTS

CN 102465486 A 5/2012
CN 107366215 A 11/2017
(Continued)

OTHER PUBLICATIONS

China office action for corresponding patent application No. 2022022800647530, dated Mar. 3, 2022, 8 pages (not prior art).
(Continued)

*Primary Examiner* — Janine M Kreck
(74) *Attorney, Agent, or Firm* — Lucian Wayne Beavers; Patterson Intellectual Property Law PC

(57) ABSTRACT

The present invention relates to an earth working method for removing earth material by means of a tool (14) rotating around a working axis (R); the rotating tool (14) being carried by a machine frame (20) of an earth working machine (10); the machine frame (20) standing on a substrate (U) by way of a rollable propelling unit (13) and being driven by a propulsion drive apparatus (25, HM) to perform a propelled motion relative to the substrate (U) in a propulsion direction (VR); the propulsion direction (VR) enclosing with the working axis (R) an angle (β) different from 90°; and the present invention further relates to an earth working machine embodied to execute the earth working method.

11 Claims, 2 Drawing Sheets

(56) References Cited

U.S. PATENT DOCUMENTS

| | | | | |
|---|---|---|---|---|
| 4,154,481 | A | 5/1979 | Heckenhauer et al. | |
| 5,190,398 | A | 3/1993 | Swisher, Jr. | |
| 5,354,147 | A | 10/1994 | Swisher, Jr. | |
| 5,441,361 | A | 8/1995 | Campbell | |
| 6,435,766 | B1 | 8/2002 | Titford | |
| 7,175,364 | B2 | 2/2007 | Gaertner et al. | |
| 7,942,604 | B2 | 5/2011 | Willis et al. | |
| 8,485,755 | B2 | 7/2013 | Menzenbach et al. | |
| 8,671,416 | B2 | 3/2014 | Van Vechten et al. | |
| 8,764,341 | B2 | 7/2014 | Menzenbach et al. | |
| 8,764,690 | B2 | 7/2014 | Gough | |
| 8,977,442 | B2 | 3/2015 | Menzenbach et al. | |
| 10,301,782 | B2 | 5/2019 | Laux et al. | |
| 10,421,489 | B2 | 9/2019 | Held et al. | |
| 10,731,304 | B2 | 8/2020 | Laux et al. | |
| 2010/0021234 | A1* | 1/2010 | Willis | E01C 23/088 417/399 |
| 2010/0083543 | A1 | 4/2010 | Staubli | |
| 2012/0090909 | A1 | 4/2012 | Menzenbach et al. | |
| 2013/0158802 | A1* | 6/2013 | Miller | B62D 7/1509 701/41 |
| 2013/0334865 | A1* | 12/2013 | Wachsmann | E01C 23/088 299/39.2 |
| 2017/0327148 | A1 | 11/2017 | Held et al. | |

FOREIGN PATENT DOCUMENTS

| | | | |
|---|---|---|---|
| DE | 102005035480 | A1 | 2/2007 |
| DE | 102010013983 | A1 | 10/2011 |
| DE | 102016003895 | A1 | 10/2017 |
| DE | 102016009646 | A1 | 2/2018 |
| EP | 2076419 | A2 | 7/2009 |
| EP | 2079419 | A1 | 7/2009 |
| EP | 2441888 | A2 | 4/2012 |
| FR | 1266660 | A | 7/1961 |
| FR | 2406031 | A1 | 5/1979 |
| WO | 03100172 | A1 | 12/2003 |

OTHER PUBLICATIONS

European Search Report for corresponding patent application No. EP 20 21 4751 dated Jun. 1, 2021, 9 pages (not prior art).

Third Party Observation filed in corresponding EPO Application Serial No. EP 20200214751.

* cited by examiner

REMOVING EARTH WORKING METHOD WITH A REMOVING TOOL OFFSET OBLIQUELY WITH RESPECT TO THE PROPULSION DIRECTION, AND EARTH WORKING MACHINE EMBODIED TO EXECUTE THE METHOD

CROSS-REFERENCES TO RELATED APPLICATIONS

This application claims benefit of German Patent Application No. DE 10 2019 135 867.1, filed on Dec. 30, 2019, which is hereby incorporated by reference in its entirety.

BACKGROUND OF THE INVENTION

1. Field of the Invention

The present invention relates to an earth working method for removing earth material by means of a tool rotating around a working axis; the rotating tool being carried by a machine frame of an earth working machine; the machine frame standing on a substrate by way of a rollable propelling unit and being driven by a propulsion drive apparatus to perform a propelled motion relative to the substrate in a propulsion direction. The propelled motion of the earth working machine ensures, in the present invention as well, an advancing motion of the rotating tool.

The present invention furthermore relates to an earth working machine, for instance a road milling machine, recycler, stabilizer, or surface miner, that is embodied to execute the earth working method recited above.

2. Description of the Prior Art

The aforementioned earth working method is sufficiently known from the existing art. It is used by earth working machines, in particular in the form of road milling machines, recyclers, stabilizers, or also a variety of surface miners, to remove earth material as intended. Merely by way of example and representatively, reference may be made, in the existing art regarding the aforementioned earth working method and regarding an earth working machine, in the form of road milling machines, embodied to execute it, to DE 10 2005 035 480 A1, to DE 10 2016 003 895 A1 (U.S. Pat. No. 10,731,304), or also to WO 03/100172 A (U.S. Pat. No. 7,175,364), to name only a few. As a rule, when the known road milling machines are traveling straight ahead, their propulsion direction, which is the advance direction of the rotating tool, is orthogonal to the working axis of the tool. The removal of earth material is accomplished principally by way of milling bits that are arranged on the enveloping surface that proceeds around the working axis.

As described in more detail in DE 10 2010 013 983 A1 (U.S. Pat. No. 8,672,416), which likewise relates to a road milling machine, the end faces of the rotating removing tool are subject to disproportionately high wear compared with the wear on the enveloping surface that carries milling bits. This is due in part to the fact that the end faces of the tool (in the case of the aforementioned documents, of a milling drum constituting the tool) come into more intense contact with the earth material that is to be, or has already been, removed than does the enveloping surface located between the end faces, which is protected by the milling bits arranged thereon, to a greater degree than the end faces, from contact with the earth material. A further reason for this is that the end faces of the rotating tool are oriented parallel to the propulsion direction of the earth working machine and thus to the advance direction of the tool, and any milled edges in the earth generated by the tool itself can thus slide along the end faces in contact therewith, producing a highly abrasive effect.

DE 10 2010 013 983 A1 (U.S. Pat. No. 8,672,416) consequently proposes, in order to counteract this end-face wear, also to provide milling bits on the end face of a milling drum, so that the region axially adjacent to an end face, outside the tool or the milling drum, is also cleared by milling bits. A disadvantage of this approach is the large outlay for manufacture and installation of such a milling drum having end-face milling bits, which must be repeated in the context of maintenance operations. On the one hand, additional milling bits must be attached to the milling drum; on the other hand, a milling bit is more difficult to attach in stable fashion to the end face than to the enveloping surface where, unlike on the end face, a relatively large surface region is available for attachment of each milling bit.

SUMMARY OF THE INVENTION

The object of the present invention is therefore to describe a technical teaching which permits earth material to be removed in defined fashion with a rotating tool without additional outlay for manufacture and installation of the tool, and in that context to reduce or even eliminate the above-described elevated end-face wear on the removing tool.

The present invention achieves this object, in the context of the earth-removing earth working method recited initially, by the fact that the propulsion direction of the machine frame and thus of an earth working machine comprising the rotating tool, and consequently the advance direction of the rotating tool, enclose with the working axis, during a removing earth working operation, an angle different from 90°.

Because of this orientation, relative to the propelled motion of the earth working machine, of the working axis and thus of the rotating tool during the removal of earth material, it is possible to embody a longitudinal end of the tool which is axial with reference to the working axis as a trailing longitudinal end in the propulsion direction, so that this trailing longitudinal end moves essentially in the removal "shadow" of the tool in the propulsion direction, so that it moves, during earth working by the tool as intended, within a volume region cleared in the earth by the removing cutting means of the rotating tool, and therefore comes into contact only to a very limited extent, or not at all, with earth material. The end face of the trailing longitudinal end of the rotating tool is therefore turned away from the removal edge generated by the tool in the worked earth by the same angle by which the propulsion direction is canted with respect to a plane orthogonal to the working axis.

The earth material can therefore have little or no abrasive effect on the trailing longitudinal end. The wear stress on the trailing longitudinal end is therefore low, so that the placement of cutting means, for instance milling bits, on the end face of the tool can be dispensed with. The earth-removing method can therefore be executed with a conventional rotating tool, with no particular protection of the trailing end face.

It might now be objected that the tool, offset as described above relative to the propulsion direction, has not only a trailing longitudinal end but also a leading longitudinal end, for which the wear conditions change disadvantageously because of how the tool is offset. This is not an obligatory operating condition of the leading longitudinal end of the offset tool, however, since the leading longitudinal end does not necessarily have to be in removing engagement with the earth to be worked. According to a preferred refinement of the earth working method described here, provision is therefore made that the rotating tool extends, with reference to the working axis, between two axial longitudinal ends; the tool comprising, because of the orientation of the working axis, a leading axial longitudinal end and a trailing axial longitudinal end in the propulsion direction; the axial removal width being selected in such a way that the trailing longitudinal end is in removing engagement with the earth material to be removed, but the leading longitudinal end is not.

The reason is that earth surfaces that are to be removed are, as a rule, wider than the removal width, even the maximum possible removal width, of the rotating tool, so that in almost all working instances an earth surface to be removed is removed in several parallel strips that are traveled along in succession. It is thus easily possible, for the second and each subsequent strip to be removed, to arrange the leading longitudinal end on the already-worked side of a removal edge that has already been generated, and to bring into removing engagement with the earth only a portion, axial with reference to the working axis, of the rotating tool which contains only the trailing longitudinal end. The leading longitudinal end is therefore out of engagement with the earth to be removed, and the trailing longitudinal end is arranged with an angular spacing away from the removal edge generated during the respective working operation.

It is correct that as a result of the oblique offset of the working axis with respect to the propulsion direction of the earth working machine, the maximum achievable removal width of the tool is reduced as compared with a removing earth working operation in which the propulsion direction is oriented orthogonally to the working axis. The percentage loss of maximum achievable removal width corresponds to a value of 1 minus the cosine of the setting angle at which the propulsion direction is offset with respect to a plane orthogonal to the working axis. The percentage loss of maximum achievable removal width is therefore less than 3.5% for a setting angle of 15°, and slightly over 1.5% for a setting angle of 10°. The setting angle is therefore 15° or less, particularly preferably 10° or less. Most preferably, the setting angle is 5° or less, for instance between 5° and 3°, but greater than 0°. With a setting angle of 5°, a considerable decrease in wear on the trailing longitudinal end of the rotating tool is already achieved, but the loss of maximum possible working width is less than 0.4%. Compared with the considerable achievable decrease in wear on the rotating tool, the aforementioned losses of maximum possible working width are virtually negligible.

In principle, the rotating tool could be arranged on the machine frame of the earth working machine with a working axis that is canted by an amount equal to the setting angle with respect to a reference plane that is spanned by a roll axis extending parallel to the longitudinal machine frame direction and by a yaw axis, extending parallel to the vertical machine direction, of the earth working machine. The earth working machine can then simply be moved straight ahead along its roll axis during a removing earth working operation, the trailing edge already being arranged by design remotely from a removal edge as a result of the angled arrangement of the tool. This very simple working method, which is uncomplicated for the machine operator, has the disadvantage, however, that in the context of the first strip of an earth removing operation, often the leading longitudinal end is also in removing engagement with the earth to be removed and is thus exposed to greater wear-related stress during that first strip. According to an advantageous refinement of the present invention, this can be prevented by the fact that the propelling unit comprises a plurality of steerable drive units that are rollable on the substrate, the earth working method encompassing a steering of the drive units in such a way that when the earth working machine is traveling straight ahead, the propulsion direction encloses an angle with a roll axis extending parallel to the longitudinal machine frame direction. The working axis can then have a fixed angular orientation relative to the reference plane, preferably can be orthogonal to it.

As a rule, earth working machines in any case comprise steerable drive units that are rollable on the substrate. By establishing the setting angle by way of corresponding steering of the drive units, however, the first strip of a removing earth working operation can be carried out conventionally without a working axis offset obliquely with respect to the propulsion direction, i.e. with a working axis orthogonal to the reference plane, the propulsion direction of the earth working machine extending parallel to the roll axis during the first strip so that the propulsion direction of the earth working machine, and thus the advance direction of the rotating tool, are oriented orthogonally to the latter's working axis.

Once the first strip is completed, a removal edge is generated as a boundary configuration between the removed first strip and the remaining earth surface that is still to be, but has not yet been, removed, so that the second and each further strip can be effected by corresponding steering or steering adjustment of the drive units with a working axis offset with respect to the propulsion direction and consequently with no working engagement of the leading longitudinal edge of the tool.

The last-named manner of generating the above-described propelled motion by corresponding steering of the drive units causes the longitudinal machine direction, or the roll axis of the earth working machine, to deviate in terms of angle during earth working, by an amount equal to the setting angle, from the longitudinal direction of the substrate to be worked, for instance the strips to be removed. This can in fact be the case for curved strip profiles of a strip that is to be removed. Whereas here, in a context of conventional earth working the roll axis of the earth working machine as a rule is oriented parallel to a local tangent to the curved strip profile at the location of the earth working machine, in accordance with the earth working method described here, the roll axis deviates in terms of angle during earth working, even with curved strip profiles, from the local tangent to the curved strip profile at the respective working location of the earth working machine along the working strip, as a rule once again by an amount equal to the setting angle.

The present invention furthermore relates to a mobile earth-removing earth working machine encompassing a propelling unit embodied to stand on a substrate and having a plurality of steerable drive units that are rollable on the substrate; the propelling unit supporting a machine frame that carries a working apparatus having an earth-removing tool rotatable around a working axis; the working axis being arranged with a constant angular orientation relative to the aforementioned reference plane that is spanned by a roll axis extending parallel to the longitudinal machine frame direction and by a yaw axis, extending parallel to the vertical machine direction, of the earth working machine. The earth working machine comprises a working drive apparatus in order to drive the tool to rotate around the working axis, and the earth working machine comprises a propulsion drive apparatus in order to drive the earth working machine to perform a propelled motion relative to the substrate on which it is standing. The earth working machine furthermore comprises a steering apparatus in order to modify a steering angle of the plurality of steerable drive units relative to the reference plane.

The object recited initially is also achieved by the present invention by the fact that the mobile earth working machine is embodied to execute the removing earth working method as described and refined above. With regard to the technical advantages that are achievable by an earth working machine embodied to execute the earth working method described above, reference is made to the explanation of the earth working method. Embodiments and refinements of an earth working machine which are disclosed in connection with the description of the earth working method are refinements of the earth working machine according to the present invention. Refinements of the earth working method which are disclosed in connection with the explanation of the earth working machine according to the present invention are likewise refinements of the earth working method according to the present invention.

The earth working machine can be embodied to execute the earth working method according to the present invention by way of a controller of the earth working machine. The controller can encompass one or several integrated circuits and a data memory, for instance in the form of an onboard computer or a programmable control system. The controller can be embodied to apply control to the machine automatically, on the basis of an operating program stored in the data memory, to execute the earth working method described above. The controller can, for that purpose, output control instructions at least to the steering apparatus. A predetermined setting angle can be stored in the data memory of the controller. Provision can furthermore be made to store in the data memory a plurality of different setting angles respectively associated with at least one operating or working parameter, for instance as a function of a removal depth and/or the propulsion speed and/or the type of earth material to be removed, and to select a suitable setting angle depending on operating parameters of the imminent, or just-performed, earth working operation. The selection can also be made automatically by the controller after input of the operating parameters necessary therefor.

As already explained in connection with the earth working method according to the present invention, the earth working machine is preferably embodied to travel, during earth-removing working operation of the working apparatus, straight ahead in a propulsion direction that encloses, with a working plane that extends parallel to the yaw axis and contains the working axis, an angle different from 90°. In the interest of clarity, what is to be used as the enclosed angle is always the smallest of several recognizable angles enclosed between the propulsion direction and the working plane. The setting angle described above, which is the angle enclosed between the propulsion direction and the reference plane, is also the angular amount by which the two angles formed, with the working plane, by a yaw-axis-parallel propulsion plane extending in the propulsion direction, differ from a right angle. The smaller angle that is relevant here is reduced with respect to a right angle by the value of the setting angle; the second, larger angle that exists between the propulsion plane and the working plane is increased with respect to a right angle by the value of the setting angle.

The rollable drive units can comprise wheels (as wheel drive units) and/or recirculating tracks (as crawler track units). A mixed arrangement of drive units of different design on a given earth working machine is also conceivable; for instance, drive units of one design type from among wheel drive units and crawler track units are arranged at the front longitudinal end, and drive units of the respective other design type are arranged at the rear longitudinal end of the earth working machine.

As has already been stated in connection with the working method, the possibility exists in principle of fastening the rotating tool on the machine frame in such a way that its working axis is located in a working plane that is already rotated, by an amount equal to the setting angle, with respect to a plane that is orthogonal to the reference plane and contains the yaw axis. A substrate that is to be worked can then be removed in strips using a propulsion direction that lies in (or, equivalently, parallel to) the reference plane.

A greater bandwidth of possible earth working operations can be achieved, however, by the fact that the working axis is arranged orthogonally to the reference plane; and that the steering apparatus is embodied to orient the plurality of steerable drive units with a respective steering angle such that the propulsion direction of the earth working machine when traveling straight ahead encloses an angle with the roll axis. The angle enclosed with the roll axis is the setting angle described above. The advantage of achieving the oblique offset of the rotating tool by way of the steering apparatus is on the one hand that the fundamental configuration of known earth working machines does not need to be modified, since in such machines the working axis of the rotating tool is usually permanently oriented orthogonally to the reference plane. The further advantage is that by corresponding adjustment of the steering apparatus, assuming an earth working machine having a working axis orthogonal to the reference plane, it is possible to work both conventionally with a propulsion direction orthogonal to the working axis, i.e. with a setting angle of 0°, and in the particular manner referred to here, with a setting angle differing from 0° and thus with a trailing longitudinal end, so that during a removing earth working operation while traveling straight ahead, the end face of the trailing longitudinal end is spaced angularly away from a generated removal edge by an amount equal to the setting angle and is thus arranged in almost contact-free fashion.

It is conceivable in principle for a propelling-unit axle of the earth working machine to be constituted by only a single drive unit. For maximally stable support of the earth working machine on a substrate, however, at least one propelling-unit axle is, preferably at least two propelling-unit axles are, constituted by two drive units that are located along the roll axis at a substantially shared axial position but on different sides of the reference plane. For maximally slip-free and therefore low-wear steering of the earth working machine, provision is preferably made that at least two drive units of a shared propelling-unit axle are connected to one another by a tie rod for steering motion together. This makes possible, for example, steering of the earth working machine while maintaining Ackermann geometry. In order to avoid transverse slip at one or both drive units of a propelling-unit axle when executing the earth working method according to the present invention in the context of the aforesaid preferred configuration of a steering linkage and/or steering gearbox, the tie rod can be embodied to be modifiable in length. When tie rods are used, the transverse slip results from the fact that upon execution of the earth working method according to the present invention, the steering angle of drive units of a propelling-unit axle is different from 0°, the use of a tie rod ensuring that the steering angle of the drive unit on the inside of the curve is quantitatively larger than the steering angle of the drive unit on the outside of the curve. When an attempt is made to travel straight ahead with such a steering setting, transverse slip occurs because of the difference in the magnitudes of the steering angles on a given propelling-unit axle.

Modifiability of the length of the tie rod can be achieved by way of a piston/cylinder arrangement, the piston of which is coupled to the one drive unit and the cylinder of which is coupled to the respective other drive unit of the same propelling-unit axle. The piston/cylinder arrangement can be part of the tie rod or can span a separating point of a two-part, in particular telescopable, tie rod. Alternatively, the tie rod can be configured to be modifiable in length by way of a spindle drive. This also requires an at least two-part tie rod, the two parts of which are displaceable relative to one another in the longitudinal tie-rod direction.

In addition or alternatively to prevention of transverse slip by way of a modifiable-length tie rod, transverse slip can also be reduced or entirely eliminated by the fact that at least two drive units of a shared propelling-unit axle are connected to one another by a tie rod for steering motion together; each longitudinal end of the tie rod being connected by a respective steering arm to the respective other drive unit of the same propelling-unit axle; a steering arm being rotatable, relative to the drive unit carrying it, around a correction axis parallel to the yaw axis. A steering arm that transfers a steering motion can thus be rotated, relative to the drive unit that carries it, around the correction axis, so that in that manner as well it is possible to ensure that despite a steering input, both drive units of a shared propelling-unit axle which are coupled by a tie rod exhibit a steering angle of the same magnitude.

The values for correction motions, in the form of a change in the length of a modifiable-length tie rod and/or in the form of a rotation of a steering arm around the correction axis, are also preferably stored in the data memory of the controller. The controller is preferably embodied to apply control to an actuator that brings about the respective correction motion. But because, as already stated above, the setting angle as a rule is quantitatively small, in particular equal to less than 15° or even less than 10°, a small amount of transverse slip generated thereby can also easily be accepted.

As is usual for the earth working machine envisioned here, the machine frame is preferably carried vertically adjustably on the propelling unit. The removal depth of the tool, i.e. the depth to which the tool engages into the earth to be removed, can thus easily be adjusted by vertical displacement of the machine frame and thus of the working axis, which as a rule is fixed relative to the machine frame. Preferably, individual or all drive units of the propelling unit are connected to the machine frame via lifting columns known per se, so as thereby to achieve vertical adjustability of the machine frame.

The tool is preferably a milling drum that carries milling bits at least on its enveloping surface that proceeds with a radial spacing around the working axis. In order to facilitate the discharge of already-removed earth material away from the milling drum, at least a plurality of the milling bits are arranged helically on the enveloping surface. Because the milling bits are exposed to severe wear stress because of their engagement with, as a rule, mineral surfaces such as road pavements, the milling bits are preferably arranged in so-called quick-change bit holders on a milling drum tube constituting a basic element of the milling drum, in order to make them easier to replace when their wear limit is reached.

As has already been described above, embodiment of the earth working machine to execute the above-described earth working method does not, or not necessarily, mean that the earth working machine is embodied only for execution of the above-described earth working method. Specifically for the removal of a first strip of several parallel removal strips, it is advantageous if the earth working machine is also embodied to travel, during an earth-removing working operation of the working apparatus, straight ahead in a propulsion direction that is oriented orthogonally to the working plane. To achieve this, the steering apparatus is preferably also embodied to orient the plurality of steerable drive units with a respective steering angle such that the propulsion direction of the earth working machine when traveling straight ahead is parallel to the roll axis.

The earth working machine discussed here is preferably a road milling machine, in particular (but not only) a large road milling machine having a milling drum, constituting the rotating tool, arranged between drive units of a front propelling-unit axle and drive units of a rear propelling unit axle, a recycler, a stabilizer, or a surface miner.

BRIEF DESCRIPTION OF THE DRAWINGS

The present invention will be explained in further detail below with reference to the appended drawings, in which.

DETAILED DESCRIPTION

Figure 1:
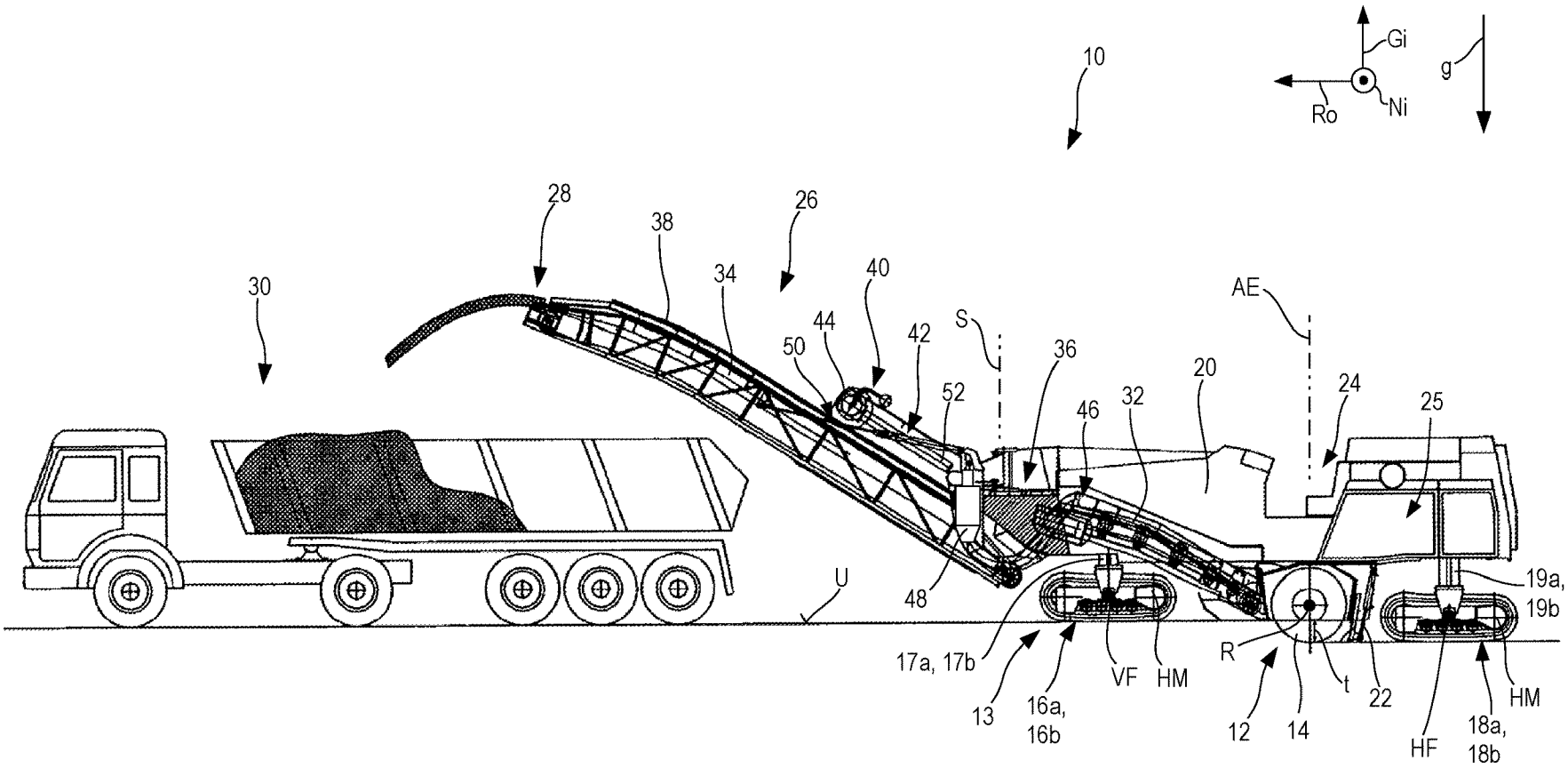
FIG. 1 is a schematic side view of an earth working machine according to the present invention during conventional operation to remove earth material.
Figure 2:
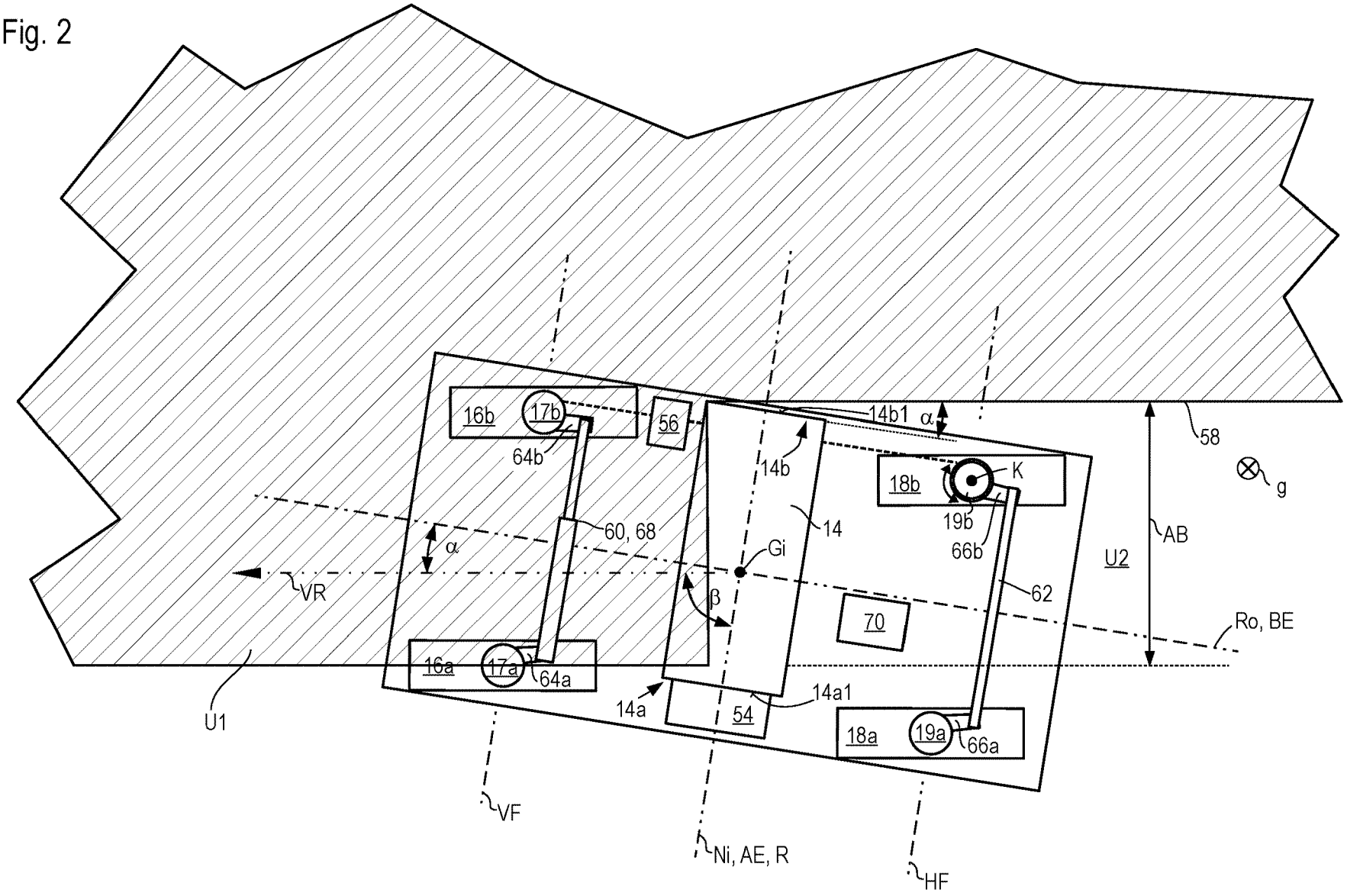
FIG. 2 is a schematic plan view of the earth working machine according to the present invention of FIG. 1 during operation to remove earth material in accordance with the earth working method according to the present invention.

In FIGS. 1 and 2, an earth working machine according to the present invention (hereinafter referred to simply as a "machine") is labeled in general with the number 10. Depicted by way of example as machine 10 according to the present invention is a large road milling machine whose working apparatus 12, having a milling drum 14 known per se as an earth-removing rotating tool (as is typical for large road milling machines), is arranged between front drive units 16*a* and 16*b* and rear drive units 18*a* and 18*b*. Front drive units 16*a* and 16*b*, of which drive unit 16*b* is concealed by drive unit 16*a* in FIG. 1, constitute a front propelling-unit axle VF. Rear drive units 18*a* and 18*b*, of which drive unit 18*b* is concealed by drive unit 18*a* in FIG. 1, constitute a rear propelling-unit axle HF. Drive units 16*a*, 16*b* and 18*a*, 18*b* are embodied by way of example as crawler track units. Drive units 16*a*, 16*b* and 18*a*, 18*b*, each drivable preferably by a hydraulic motor HM for propelled motion, together constitute a propelling unit 13, are steerable, and carry a machine frame 20 that in turn carries working apparatus 12. Machine 10 is thus a self-propelled vehicle.

The effective direction of gravity is labeled in FIGS. 1 and 2 with an arrow g.

Milling drum 14, rotatable around a working axis R that is orthogonal to the drawing plane of FIG. 1 and extends parallel to pitch axis Ni of machine 10, is shielded with respect to the external environment of machine 10 by a milling drum housing 22 that supports milling drum 14 rotatably around working axis R. Milling drum housing 22 is open toward substrate U, on which machine 10 stands with drive units 16*a*, 16*b* and 18*a*, 18*b*, and which milling drum 14 removes, in order to enable earth working as intended by machine 10.

Machine frame 20 is connected to the respective drive units 16*a*, 16*b*, 18*a*, 18*b* vertically adjustably along yaw axis Gi via front lifting columns 17*a* and 17*b* and rear lifting columns 19*a* and 19*b*, with the result that, for example, the milling depth t of milling drum 14 is adjustable.

Machine 10 is controllable from an operator's platform 24. Operator's platform 24 can be roofed in known fashion. An internal combustion engine 25 supplies the drive energy, inter alia, for hydraulic motor HM constituting the propulsion drive apparatus of machine 10, for working drive apparatus 54 (see FIG. 2) to rotate milling drum 14, and for steering apparatus 56 (see FIG. 2) to steer machine 10.

Earth material removed by milling drum 14 during earth working as intended is conveyed by a transport apparatus 26 from working apparatus 12 to a delivery location 28 where it is transferred, in the example depicted, to a transport truck 30 that accompanies and precedes machine 10 with a spacing in the direction of roll axis Ro during earth working.

Roll axis Ro and yaw axis Gi span a reference plane BE which is parallel to the drawing plane of FIG. 1 and is depicted and characterized in FIG. 2.

Transport apparatus 26 encompasses a receiving belt 32 located closer to working apparatus 12 and an ejector belt 34 that interacts with receiving belt 32 and is located farther from working apparatus 12. Receiving belt 32 is mounted on machine frame 20 in circulation-capable fashion, but unmodifiably with regard to its orientation relative to machine frame 20. At a transfer point 36, receiving belt 32 transfers the material conveyed by it onto ejector belt 34, which conveys the received material to delivery location 28. Ejector belt 34 is likewise circulation-capable but is pivotable relative to machine frame 20 around a yaw-axis-parallel pivot axis S and is preferably tiltable around a tilt axis orthogonal to pivot axis S, so that delivery location 28, which coincides with the ejecting longitudinal end of ejector belt 34, is movable approximately over the surface of a spherical or shell in order to adapt delivery location 28 to the respective accompanying vehicle 30.

Transport apparatus 26 is enclosed along its entire length by an enclosure 38 in order to avoid contamination of the external environment of transport apparatus 26 with dust and with material that might possibly drop off transport apparatus 26. That part of enclosure 38 which is located above receiving belt 32 is implemented for the most part by machine frame 20.

To further reduce emissions of dirt, in particular dust, from machine 10 because of working apparatus 12, the latter encompasses an extraction device 40 having a filter apparatus 42.

Extraction device 40 extracts dust-laden air at an extraction location 46 that can be located, for example, above receiving belt 34, and conveys the dust-laden air, in the order indicated, through a prefilter 48 and through filter apparatus 42 to a discharge location 50 that either can be an outlet on conveying fan 44 which discharges directly into the external surroundings of machine 10 or can be, above ejector belt 34, an opening in enclosure 38 through which the cleaned air is taken back to transport apparatus 26, so that the cleaned air, together with the removed substrate material, emerges at delivery location 28 into the surroundings of machine 10.

Shown in filter apparatus 42 is a filter element 52 whose longitudinal axis is oriented substantially parallel to the transportation direction or to the running direction of ejector belt 34.

Machine 10 is depicted in FIG. 1 during a conventional removing earth working operation in which propulsion direction VR of machine 10 when traveling straight ahead is located in the reference plane parallel to the drawing plane of FIG. 1.

During straight-ahead travel in the conventional earth working mode, front propelling-unit axle VF and rear propelling-unit axle HF are oriented orthogonally to the reference plane parallel to the drawing plane of FIG. 1.

Working axis R, specified relative to machine frame 20, is oriented by design permanently orthogonally to the reference plane. A working plane AE, which contains working axis R and is parallel to yaw axis Gi, is therefore oriented in FIG. 1 orthogonally to the drawing plane of FIG. 1 and thus orthogonally to the reference plane. Upon execution of the conventional earth working method depicted in FIG. 1, a propulsion direction of the propelled motion of machine 10 therefore extends parallel to roll axis Ro of machine 10.

FIG. 2 depicts machine 10 of FIG. 1 in a schematic plan view during working in accordance with the above-described earth working method according to the present invention. In this method, propulsion direction VR in which machine 10 travels straight ahead is canted with respect to reference plane BE by an amount equal to a setting angle $\alpha$. Propulsion direction VR therefore encloses, with working axis R or with working plane AE spanned by working axis R and yaw axis Gi, an angle different from 90°; according to the definition given above, the smallest angle $\beta$ of the angles ascertainable between propulsion direction VR and working axis R, or working plane AE, is to be authoritative. As compared with the conventional earth working method shown in FIG. 1, according to which propulsion direction VR is located in reference plane BE, the angle $\beta$ between propulsion direction VR and working plane AE is decreased by an amount equal to setting angle $\alpha$.

Milling drum 14 thus has, with reference to propulsion direction VR, a leading longitudinal end 14*a* and a trailing longitudinal end 14*b*.

In FIG. 2, U1 designates with cross-hatching a substrate region that is yet to be worked, and for differentiation therefrom an already worked substrate region is labeled U2. Worked substrate U2 is delimited by milled edge 58 formed by milling drum 14 during the current milling operation. Working width AB in FIG. 2 indicates the width over which earth is removed by milling drum 14 during the earth-removing working method.

Because of the fixed machine-frame-related orientation of working axis R orthogonally to reference plane BE, trailing longitudinal end 14*b* of milling drum 14 is rotated away from milled edge 58 by the same setting angle $\alpha$ by which propulsion direction VR is canted with respect to reference plane BE. As a result, end face 14*b*1 at trailing longitudinal end 14*b* of milling drum 14 experiences considerably less abrasive stress as a result of milling operation than in the case of the previously described conventional removing earth working operation with a propulsion direction orthogonal to working axis R. Leading longitudinal edge 14*a*, conversely, is not in removing engagement with substrate region U1 that is yet to be worked, so that leading longitudinal end 14*a* and its end face 14*a*1 are not abrasively stressed except by removed earth material that is thrown around in milling drum housing 22.

The oblique offset of milling drum 14, or of its working axis R, with respect to propulsion direction VR, as shown in FIG. 2, is brought about by steering apparatus 56, which has turned front drive units 16*a* and 16*b* and rear drive units 18*a* and 18*b* with respect to reference plane BE, by an amount equal to steering angle α, in such a way that even though a steering angle α different from 0° is set, machine 10 travels straight ahead in propulsion direction VR, reference plane BE and thus roll axis Ro of machine 10 being oriented with a cant equal to the angle α with respect to propulsion direction VR.

Front drive units 16*a* and 16*b* of front propelling-unit axle VF and rear drive units 18*a* and 18*b* of rear propelling-unit axle HF are, expressed generally, aligned codirectionally and with a quantitatively equal steering input angle, in particular steering angles, with regard to reference plane BE, in order to achieve the motion necessary for the earth working method presented here with a propulsion direction VR deviating from the roll axis. The steering input angle here is the steering control angle inputted into the steering apparatus of a vehicle axle. The steering angle is the angle, resulting at the individual drive units from the associated steering input angle, that is enclosed with the reference plane by the rolling plane, orthogonal to the rolling axis of the respective drive unit, of the drive unit.

Because the two drive units 16*a* and 16*b* of front propelling-unit axle VF and rear drive units 18*a* and 18*b* of rear propelling-unit axle HF are each coupled to one another by respective tie rods 60 and 62 for steering motion together, front tie rod 60 being arranged in a manner known per se to connect two front steering arms 64*a* and 64*b*, and rear tie rod 62 being arranged in a manner known per se to connect two rear steering arms 66*a* and 66*b*, as a rule it is not possible, without further measures, to establish the same steering angle at both drive units of a given propelling-unit axle despite a uniform steering input angle. Without further measures, a certain transverse slip occurs when traveling straight ahead with a propulsion direction VR canted with respect to reference plane BE, although for the usual small values of a that slip also has only a small value and can therefore be ignored.

When the transverse slip is not to be ignored, this can either be achieved by way of a modifiable-length tie rod, as depicted by way of example on front tie rod 60, which is embodied in modifiable-length fashion as a piston/cylinder unit 68, or can be achieved by relative rotatability of a steering arm relative to the steering axis, associated with it, of its drive unit, as indicated on the rear idle-side steering arm 66*b* which is rotatable relative to its lifting column 19*b* around a correction axis K parallel to yaw axis Gi. What can be achieved by way of one or several of the aforesaid measures is therefore that the drive units of the same propelling-unit axle, which are steered together by way of an above-described trapezoidal steering linkage made up of one steering arm per drive unit and one tie rod connecting the steering arms, are oriented parallel to one another when a uniform steering input angle is applied, including with steering angles of equal magnitude with regard to reference plane BE.

Alternatively to the above-described trapezoidal steering linkage made up of steering arms and a tie rod connecting the steering arms of a propelling unit axle, each drive unit can also be steered via a dedicated steering actuator regardless of the steering state of any other drive unit.

Low-wear earth working for milling drum 14 at its longitudinal ends 14*a* and 14*b* is thus possible without any change in design and without any physical protection measures on the longitudinal ends, compared with conventional earth working with a propulsion direction VR orthogonal to working plane AE. This is of course not intended to exclude that in addition to the earth working method described here, wear protection measures can be applied at the longitudinal ends of the milling drum, for example additional clearing milling bits and/or wear-resistant material reinforcements. These measures have that much more of a wear protection effect because of the overall lower wear stress achieved by the oblique offset of milling drum 14.

Machine 10 preferably comprises a controller 70, for instance encompassing one or several integrated circuits and a data memory that is embodied to apply control to machine 10 automatically, based on an operating program stored in the data memory, to execute the above-described earth working method. Controller 70 can output control instructions, for instance steering input angle setpoints, to steering apparatus 56 for that purpose. A predetermined setting angle α can be stored in the data memory of controller 70. Consideration can also be given to storing a plurality of different setting angles respectively associated with at least one operating or working parameter, for instance as a function of the removal depth t and/or the propulsion speed and/or the type of earth material to be removed, and to select the setting angle depending on operating parameters that describe the earth working operation to be performed. The data for modifying the length of a modifiable-length tie rod such as tie rod 60, or the data for corrective rotation of a steering arm such as steering arm 66*b*, in such a way that drive units of a given propelling-unit axle, connected to one another via a trapezoidal steering linkage for steering motion together, are oriented parallel to one another despite a steering input, can also be stored in the data memory of controller 70. The controller therefore preferably also controls the compensating motion of the modifiable-length tie rod and/or of the rotatable steering arm.

The invention claimed is:

1. A mobile earth-removing earth working machine, comprising:

a machine frame having a roll axis extending parallel to a longitudinal machine frame direction and a yaw axis extending parallel to a vertical machine direction, the roll axis and the yaw axis defining a reference plane;

a propelling unit configured to support the machine frame from a substrate, the propelling unit including a plurality of steerable drive units rollable on the substrate;

a working apparatus carried by the machine frame and including an earth-removing tool rotatable around a working axis, the working axis being arranged with a constant angular orientation relative to the reference plane;

a working drive apparatus configured to drive the earth-removing tool to rotate around the working axis;

a propulsion drive apparatus configured to drive the earth working machine to perform a propelled motion in a propulsion direction relative to the substrate;

a steering apparatus configured to modify steering angles of the plurality of steerable drive units relative to the reference plane; and a controller configured to receive and store in a data memory of the controller a predetermined value of a setting angle between the propulsion direction and the reference plane, the setting angle being different from zero, and the controller being configured to output control instructions to the steering apparatus to automatically maintain the setting angle at the predetermined value during an earth-removing operation; and wherein the working axis is arranged orthogonally to the reference plane.

2. The mobile earth-removing earth working machine of claim 1, wherein:

the steering apparatus is configured to orient the plurality of steerable drive units with respective steering angles equal to the setting angle such that the propulsion direction of the earth working machine when traveling straight ahead encloses the setting angle with the roll axis.

3. The mobile earth-removing earth working machine of claim 1, wherein:

the steering apparatus includes a tie rod connecting together at least two of the steerable drive units, the at least two of the steerable drive units defining a shared propelling-unit axis, the tie rod being adjustable in length.

4. The mobile earth-removing earth working machine of claim 1, wherein:

at least two of the steerable drive units define a shared propelling-unit axis; and the steering apparatus further comprises:

two steering arms, each of the steering arms being attached to one of the at least two of the steerable drive units defining the shared propelling-unit axis, each steering arm being rotatable with the respective steerable drive unit around a correction axis parallel to the yaw axis of the machine frame; and a tie rod having two longitudinal ends connected respectively to the two steering arms.

5. The mobile earth-removing earth working machine of claim 1, wherein:

the machine frame is carried vertically adjustably on the propelling unit.

6. The mobile earth-removing earth working machine of claim 1, wherein:

the earth-removing tool is a milling drum carrying a plurality of milling bits defining an enveloping surface radially spaced around the working axis.

7. The mobile earth-removing earth working machine of claim 6, wherein:

at least a plurality of the milling bits are arranged helically on the enveloping surface.

8. The mobile earth-removing earth working machine of claim 1, wherein:

the steering apparatus is configured to orient the plurality of steerable drive units with respective steering angles such that the earth working machine can also travel during an earth-removing working operation of the working apparatus straight ahead in the propulsion direction parallel to the roll axis and oriented orthogonally to a working plane extending parallel to the yaw axis and containing the working axis.

9. The mobile earth-removing earth working machine of claim 1, wherein:

the earth working machine is a road milling machine, a recycler, a stabilizer or a surface miner.

10. The mobile earth-removing earth working machine of claim 1, wherein:

the controller is configured to maintain the setting angle by automatically controlling steering angles of the plurality of steerable drive units of the propelling unit.

11. The mobile earth-removing earth working machine of claim 1, wherein:

the steering apparatus includes a tie rod connecting together at least two of the steerable drive units, the at least two of the steerable drive units defining a shared propelling-unit axis, the tie rod being adjustable in length; and the controller is configured to store in a memory of the controller data for modifying the length of the adjustable tie rod so that the at least two of the steerable drive units are oriented parallel to one another, and the controller is configured to automatically control the length of the adjustable tie rod so that the at least two of the steerable drive units are oriented parallel to one another in response to a steering input.

* * * * *